US011674341B2

(12) United States Patent
Ishiguro et al.

(10) Patent No.: US 11,674,341 B2
(45) Date of Patent: Jun. 13, 2023

(54) VEHICLE DOOR LATCH APPARATUS

(71) Applicant: MITSUI KINZOKU ACT CORPORATION, Yokohama (JP)

(72) Inventors: Katsuyuki Ishiguro, Yokohama (JP); Hirotaka Nishijima, Yokohama (JP); Takuya Kakumae, Yokohama (JP); Shintaro Okawa, Yokohama (JP); Makoto Kaburaki, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 127 days.

(21) Appl. No.: 16/761,705

(22) PCT Filed: Mar. 19, 2018

(86) PCT No.: PCT/JP2018/010866
§ 371 (c)(1),
(2) Date: May 5, 2020

(87) PCT Pub. No.: WO2019/130607
PCT Pub. Date: Jul. 4, 2019

(65) Prior Publication Data

US 2021/0180372 A1 Jun. 17, 2021

(30) Foreign Application Priority Data

Dec. 25, 2017 (JP) ..... JP2017-248491

(51) Int. Cl.
*E05B 85/26* (2014.01)
*E05B 83/36* (2014.01)
*E05B 85/24* (2014.01)

(52) U.S. Cl.
CPC ..... *E05B 85/26* (2013.01); *E05B 83/36* (2013.01); *E05B 85/243* (2013.01)

(58) Field of Classification Search
CPC ..... E05B 85/20; E05B 85/24; E05B 85/243; E05B 85/26; E05B 83/36;
(Continued)

(56) References Cited

U.S. PATENT DOCUMENTS 5,092,639 A * 3/1992 Di Giusto ..... E05B 85/26 292/210
5,188,406 A * 2/1993 Sterzenbach ..... E05B 85/26 292/216
(Continued)

FOREIGN PATENT DOCUMENTS

DE 19913666 A1 * 9/2000 ..... E05B 77/42
DE 10 2007 045 228 A1 2/2008
(Continued)

OTHER PUBLICATIONS

Extended (Supplementary) European Search Report dated Aug. 10, 2021, issued in counterpart EP Application No. 18893757.7. (7 pages).
(Continued)

*Primary Examiner* — Kristina R Fulton
*Assistant Examiner* — Noah Horowitz
(74) *Attorney, Agent, or Firm* — WHDA, LLP

(57) ABSTRACT

A vehicle door latch apparatus has a latch that is engaged with a striker; a ratchet member rotatably supported by a ratchet shaft and that has a pawl portion, wherein the pawl portion is movable between a latch engaging position, where the pawl portion can face a full latch engaging portion of the latch, and a latch releasing position, where the pawl portion is not in contact with the full latch engaging portion, wherein release component force is generated in a latch releasing direction when latch return force is applied in a releasing direction at the latch engaging position, and the ratchet member is pushed out from the latch engaging position to
(Continued)

the latch releasing position by the release component force; a ratchet restraint that is arranged on a side of the ratchet member and that can be moved about a pin between a block position and a release position.

7 Claims, 20 Drawing Sheets

(58) Field of Classification Search
CPC ..... Y10T 292/1047; Y10T 292/1078; Y10T 292/1082; Y10S 292/23
See application file for complete search history.

(56) References Cited

U.S. PATENT DOCUMENTS

| | | | | |
|---|---|---|---|---|
| 8,474,888 | B2 | 7/2013 | Tomaszewski | |
| 8,596,694 | B2 * | 12/2013 | Taurasi | E05B 81/14 292/216 |
| 8,876,176 | B2 * | 11/2014 | Spurr | E05C 3/006 292/201 |
| 9,765,554 | B2 * | 9/2017 | Cumbo | E05B 85/26 |
| 10,648,204 | B2 * | 5/2020 | Cumbo | E05B 79/10 |
| 11,035,156 | B2 | 6/2021 | Damboiu et al. | |
| 2009/0199605 | A1 | 8/2009 | Spurr et al. | |
| 2010/0052336 | A1 | 3/2010 | Bendel et al. | |
| 2011/0012376 | A1 | 1/2011 | Hunt et al. | |
| 2014/0062100 | A1 | 3/2014 | Tamura | |
| 2014/0091581 | A1 | 4/2014 | Taurasi et al. | |
| 2015/0097379 | A1 | 4/2015 | Spurr et al. | |
| 2015/0211266 | A1 | 7/2015 | Spurr et al. | |
| 2016/0076277 | A1 | 3/2016 | Kouzuma et al. | |
| 2017/0089103 | A1 * | 3/2017 | Ottino | E05B 81/06 |
| 2021/0156175 | A1 | 5/2021 | Ishiguro et al. | |
| 2021/0180372 | A1 | 6/2021 | Ishiguro et al. | |
| 2021/0189775 | A1 | 6/2021 | Schiffer et al. | |

FOREIGN PATENT DOCUMENTS

| | | | | |
|---|---|---|---|---|
| DE | 10 2009 029 041 | A1 | 3/2011 | |
| DE | 102009029023 | A1 | 3/2011 | |
| DE | 202011003497 | U1 | 6/2012 | |
| EP | 2310601 | B1 * | 2/2016 | E05B 81/14 |
| JP | 2015-74976 | A | 4/2015 | |
| JP | 2017-223034 | A | 12/2017 | |
| JP | 2019-112875 | A | 7/2019 | |

OTHER PUBLICATIONS

International Search Report dated Apr. 4, 2018, issued in counterpart International Application No. PCT/JP2018/010866 (4 pages).
International Search Report dated Jul. 31, 2018, issued in International Application No. PCT/JP2018/018529 (counterpart to U.S. Appl. No. 16/954,352). (2 pages).
Non-Final Office Action dated Jul. 1, 2022, issued in U.S. Appl. No. 16/954,352. (15 pages).

* cited by examiner

VEHICLE DOOR LATCH APPARATUS

TECHNICAL FIELD

This application claims priority from Japanese Patent Application No. 2017-248491 filed on Dec. 25, 2017. The application is incorporated herein by reference in its entirety.

The present invention relates to a vehicle door latch apparatus. In particular, the present invention relates to a vehicle door latch apparatus that reduces release operation force that is required to disengage a ratchet from a latch.

BACKGROUND ART

In a typical prior art vehicle door latch apparatus, a ratchet engages a latch that has rotated from an unlatched position to a full-latched position, and thereby prevents the latch from rotating in a releasing direction in order to keep the vehicle door closed (in the full-latched state). Further, in the vehicle door latch apparatus, the ratchet is rotated in the latch releasing direction (a direction opposite to the latch engaging direction), by a manual release operation force from a door opening handle or by an electric release operation force from a power release mechanism, to disengage the ratchet from the latch, and thereby allows the latch to rotate in the releasing direction to make the vehicle door openable.

The latch is strongly pressed against the ratchet in the full-latched state by being strongly biased in the releasing direction by the resilient force of a latch spring and by the repulsive force of a seal member that is provided between the door and the vehicle body. The ratchet is also biased in the latch engaging direction by the resilient force of a ratchet spring. The friction force, which is generated by the latch being pressed against ratchet, and the elasticity of the ratchet spring act as resistive force against the release operation force, resulting in degradation of the operation feeling when operating the door opening handle and in an increase in the size of the power release mechanism.

Patent Document 1 discloses a vehicle door latch apparatus that reduces the release operation force for releasing a ratchet from a latch. FIG. 13 shows the mechanism for reducing the release operation force in Patent Document 1. Latch A is held in the full-latched position by engagement with ratchet B, and ratchet B is prevented from rotating in the latch releasing direction by abutting against ratchet restraint C that is provided on the side of ratchet B. In the full-latched state shown in FIG. 13, the pressure that is transmitted from latch A to ratchet B is largely supported by ratchet shaft D of ratchet B, but part of the pressure acts on ratchet B as release component force E that rotates ratchet B in the latch releasing direction.

Release component force E is set to be higher than the engagement keeping force that keeps ratchet B engaged with latch A, specifically, the sum of the friction force that is generated between latch A and ratchet B and the resilient force of the ratchet spring that biases ratchet B in the latch engaging direction. Therefore, when ratchet restraint C is rotated clockwise by the manual release operation force or by the electric release operation force in order to disengage ratchet restraint C from ratchet B, ratchet B is rotated in the latch releasing direction by release component force E and is pushed out from the latch engaging position to a latch disengaging position. As a result, ratchet B is disengaged from latch A, and the door is made openable.

In the configuration disclosed in Patent Document 1, the friction force that is generated between ratchet restraint C and ratchet B acts as force that is resistive against the release operation force. However, the resistive force is considerably reduced as compared to the force that is resistive against the release operation force in a conventional apparatus, that is, the friction force that is generated by the latch pressing the ratchet and the resistive force that arises from the elasticity of the ratchet spring, and accordingly, the release operation force can be reduced considerably.

PRIOR ART DOCUMENT

Patent Document

Patent Document 1: DE102007045228A1

SUMMARY OF THE INVENTION

Problem to be Solved by the Invention

In the configuration of FIG. 13, ratchet B cannot rotate in the latch releasing direction unless ratchet restraint C is rotated clockwise by the manual release operation force or by the electric release operation force in order to disengage ratchet restraint C from ratchet B. Due to this structural limitation, latch A can only be provided with one engaging portion F that engages ratchet B.

Here, suppose that another engaging portion, specifically, a half latch engaging portion is arranged together with engaging portion F. Per this assumption, when ratchet B engages the half latch engaging portion, ratchet B, which is held by ratchet restraint C such that it cannot be disengaged from the latch, is mechanically locked by the half latch engaging portion. Therefore, the mechanically locked state of ratchet B cannot be released by a normal operation, and it is necessary to rotate ratchet restraint C by the manual release operation force or by the electric release operation force. This makes it difficult to use a typical latch that has a half latch engaging portion and a full latch engaging portion that are arranged on the outer circumference thereof.

Means for Solving the Problem

A vehicle door latch apparatus according to a first aspect of the invention comprises:

a latch that is engaged with a striker and that is rotatable from an unlatched position to a full-latched over rotating position;

a ratchet member that is rotatably supported by a ratchet shaft and that has a pawl portion, wherein the pawl portion is movable between a latch engaging position, where the pawl portion can face a half latch engaging portion of the latch, and a latch releasing position, where the pawl portion is not in contact with the half latch engaging portion, wherein release component force is generated in a latch releasing direction when latch return force is applied in a releasing direction at the latch engaging position, and the ratchet member is pushed out from the latch engaging position to the latch releasing position by the release component force;

a ratchet restraint that is arranged on a side of the ratchet member and that can be moved about a pin between a block position and a release position, wherein at the block position, the ratchet restraint abuts against the ratchet member to prevent the ratchet member from moving from a latch engaging position, where the ratchet member engages the latch due to the release component force, to a latch disengaging position, and at the release position, the ratchet restraint is detached from the latch member to allow the latch member to move from the latch engaging position to the latch disengaging position, the ratchet restraint has a pole lever, wherein the pole lever can be disengaged from the full latch engaging portion by rotating about a connecting shaft in a latch disengaging direction when the ratchet restraint is at the block position, and the ratchet member has a base lever that is rotatably supported by a ratchet shaft, and the pole lever is rotatably supported on the base lever by the connecting shaft.

According to the vehicle door latch apparatus of the second aspect of the invention, in the invention of the vehicle door latch apparatus of the first aspect, the latch has a full latch engaging portion that is arranged together with the half latch engaging portion.

According to the vehicle door latch apparatus of the third aspect of the invention, in the invention of the vehicle door latch apparatus of the first or second aspect, the ratchet restraint has a blocking surface, which is an arc surface whose center is positioned at the pin, and an inclined cam surface that extends contiguous with the blocking surface and whose radius from the pin gradually decreases.

According to the vehicle door latch apparatus of the fourth aspect of the invention, in the invention of the vehicle door latch apparatus of the third aspect, the pole lever is pressed against the base lever in a latch engaging direction by resilient force of a ratchet spring, a coil portion of the ratchet spring is supported by the connecting shaft, one of spring legs of the ratchet spring is engaged with ratchet shaft, and the other is engaged with the pole lever.

According to the vehicle door latch apparatus of the fifth aspect of the invention, in the invention of the vehicle door latch apparatus of the third aspect, the base lever can be rotated from a restricted position, where the base lever is in contact with the blocking surface, to a non-restricted position by the releasing component force.

According to the vehicle door latch apparatus of the sixth aspect of the invention, in the invention of the vehicle door latch apparatus of the fifth aspect, the ratchet restraint includes a cam biasing spring that biases the ratchet restraint from the release position toward the block position.

According to the vehicle door latch apparatus of the seventh aspect of the invention, in the invention of the vehicle door latch apparatus of the third aspect, the inclined cam surface of the ratchet restraint returns the base lever from the unrestricted position to the restricted position when the ratchet restraint is returned to the block position from the release position by resilient force of the cam biasing spring.

According to the vehicle door latch apparatus of the eighth aspect of the invention, in the invention of the vehicle door latch apparatus of any one of the first to seventh aspects, the ratchet restraint can be shifted from either the block position or the release position to the other by manual release operation force.

Effect of the Invention

According to the vehicle door latch apparatus of the first aspect of the present invention, in the configuration in which ratchet member 15 is prevented from moving to the latch releasing position by ratchet restraint 21, pawl portion 15*a* of ratchet member 15 can be disengaged from latch 13 while holding ratchet restraint 21 at the block position. Further, according to the vehicle door latch apparatus of the first aspect of the present invention, pole lever 20 can be independently moved relative to base lever 19.

According to the vehicle door latch apparatus of the second aspect of the present invention, half latch engaging portion 13*c* and full latch engaging portion 13*d* can be arranged side by side in latch 13.

According to the vehicle door latch apparatus of the third aspect of the present invention, blocking surface 21*c* ensures that ratchet member 15 is prevented from moving to the latch releasing position, and ratchet member 15 can be easily returned by inclined cam surface 21*d*.

According to the vehicle door latch apparatus of the fourth aspect of the present invention, ratchet spring 17 can be rationally arranged without exerting a spring force on base lever 19.

According to the vehicle door latch apparatus of the fifth aspect of the present invention, pawl portion 15*a* can be easily disengaged from latch 13 by rotating base lever 19.

According to the vehicle door latch apparatus of the sixth aspect of the present invention, ratchet restraint 21 can be returned to the block position, which is the initial position, by cam biasing spring 23.

According to the vehicle door latch apparatus of the seventh aspect of the present invention, base lever 19 can be returned from the non-restricted position to the restricted position by the resilient force of cam biasing spring 23.

According to the vehicle door latch apparatus of the eighth aspect of the present invention, since ratchet restraint 21 can be operated by the manual releasing operation force, even if the electric operation is not available, the door opening operation and the door closing operation can still be performed.

DESCRIPTION OF EMBODIMENTS

The foregoing and other objects, features and advantages of the present application will become apparent from the following detailed description with reference to the accompanying drawings that illustrate the present application.

Figure 1:
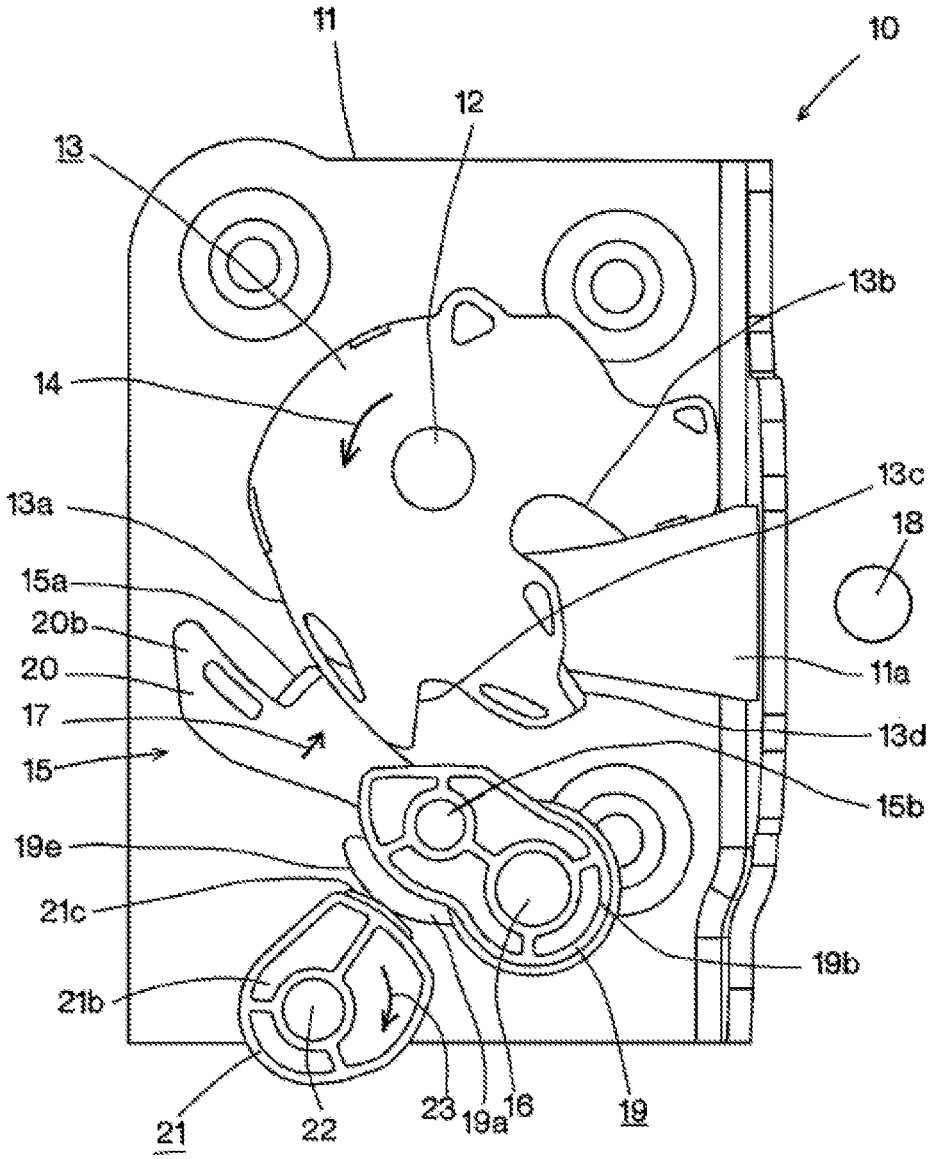
FIG. 1 is a front view of the vehicle door latch apparatus of the present embodiment showing the unlatched state (the state in which the door is open)

The present embodiment (one embodiment of the present invention) will be explained with reference to the drawings. FIG. 1 shows the front view of vehicle door latch apparatus 10 in the unlatched state (the state in which the door is opened). Latch 13 is rotatably supported on base plate 11 of vehicle door latch apparatus 10 by latch shaft 12. Latch 13 is biased in the door opening direction (the releasing direction, or the counterclockwise direction) by latch spring 14 (shown by an arrow indicating the direction of resilience). Typically, base plate 11 is fixed to a vehicle door (not shown).

Ratchet member 15 is rotatably supported on the lower part of base plate 11 by ratchet shaft 16. Ratchet member 15 is biased in the latch engaging direction by ratchet spring 17 (shown by an arrow indicating the direction of resilience). In the unlatched state shown in FIG. 1, pawl portion 15*a* of ratchet member 15 is in contact with outer circumference 13*a* of latch 13 due to the resilient force of ratchet spring 17.

When the vehicle door is moved in the door closing direction, striker 18 that is fixed to the vehicle body (not shown) relatively enters horizontal striker entrance 11*a* that is formed in base plate 11 to abut against U-shaped striker engaging groove 13*b* of latch 13. Striker S then rotates latch 13 in the door closing direction (the full-latching direction, or the clockwise direction) against the resilient force of latch spring 14. Like typical well-known latches, latch 13 has half latch engaging portion 13*c* and full latch engaging portion 13*d* that are arranged on the outer circumference thereof.

Figure 3A:
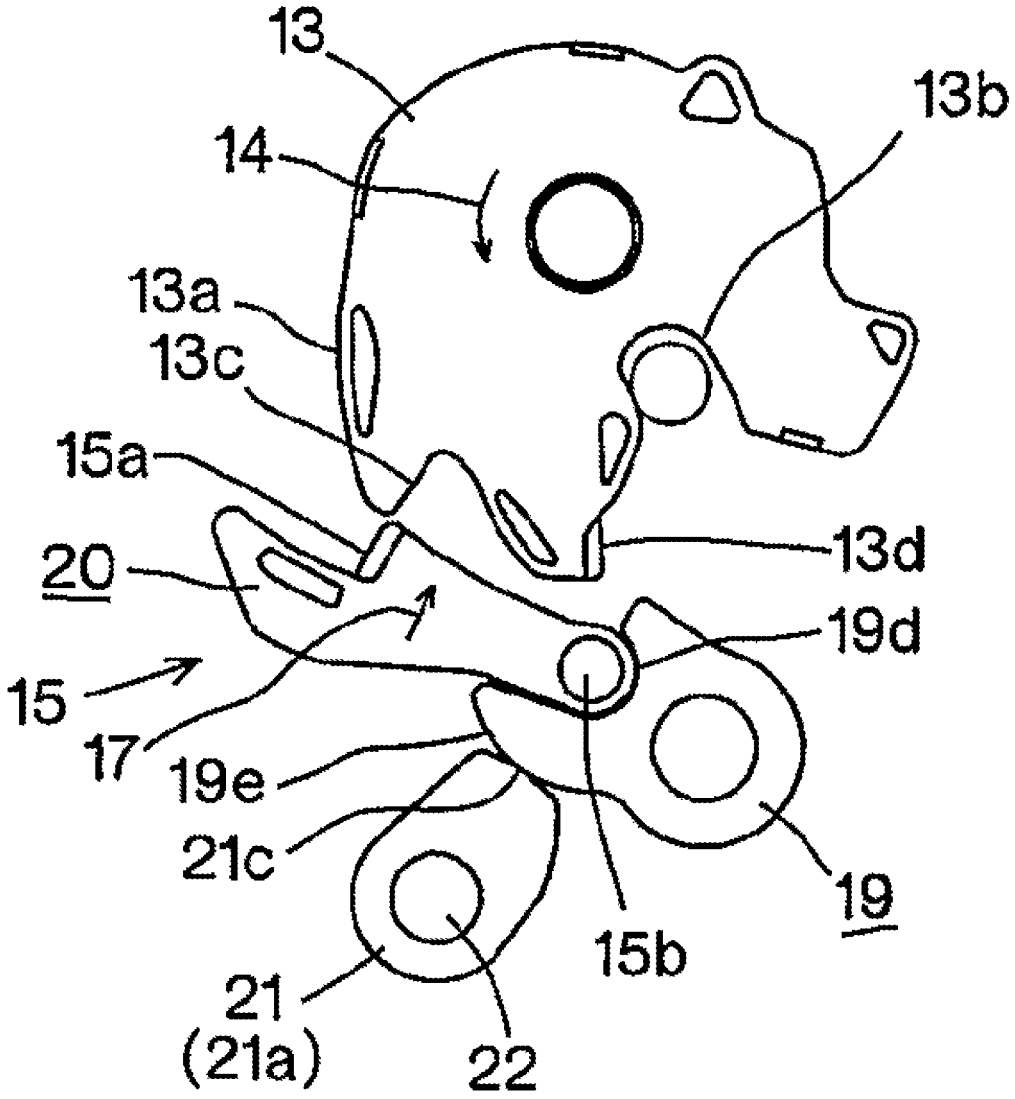
FIG. 3A is a view showing the door closing operation of the vehicle door latch apparatus of the present embodiment, wherein the latch is positioned at the half-latched position after rotation.
Figure 3B:
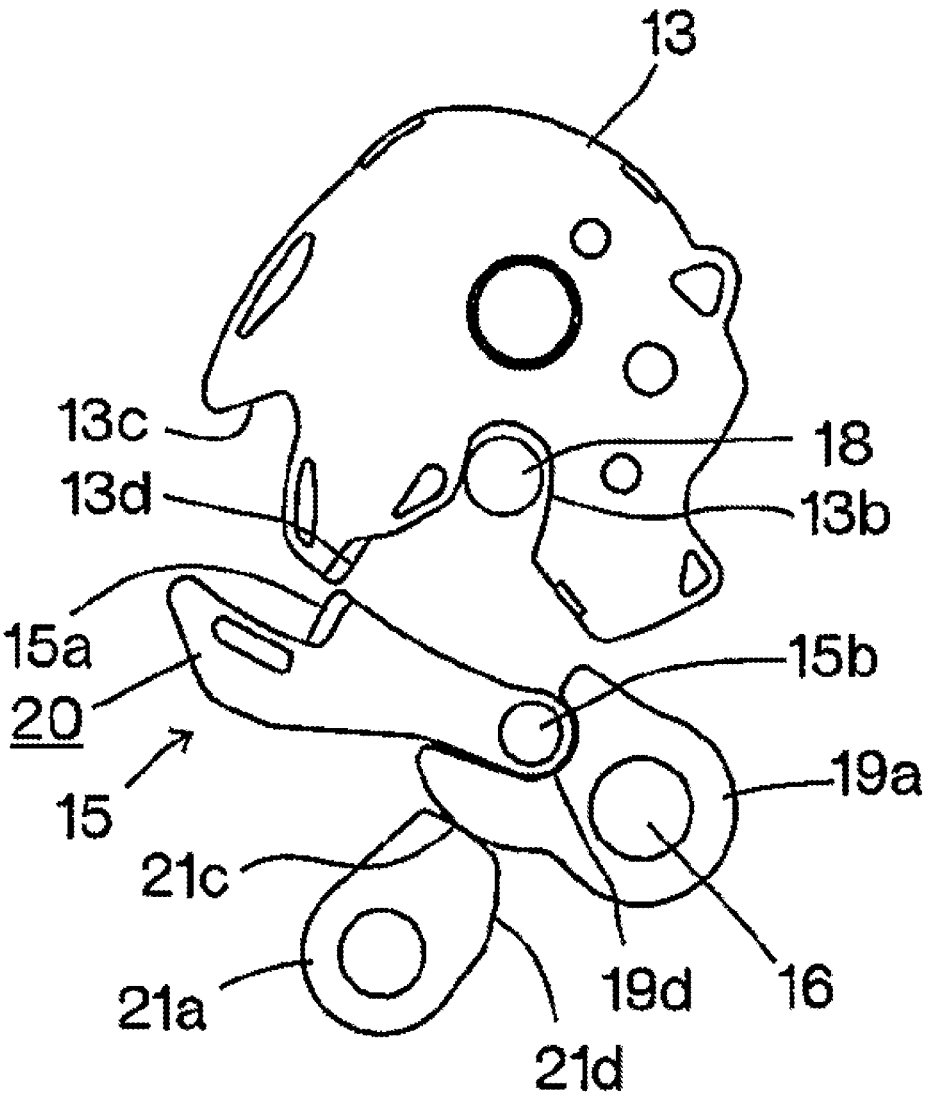
FIG. 3B is a view showing the door closing operation of the vehicle door latch apparatus of the present embodiment, wherein the latch is positioned at the full-latched position after rotation.
Figure 3C:
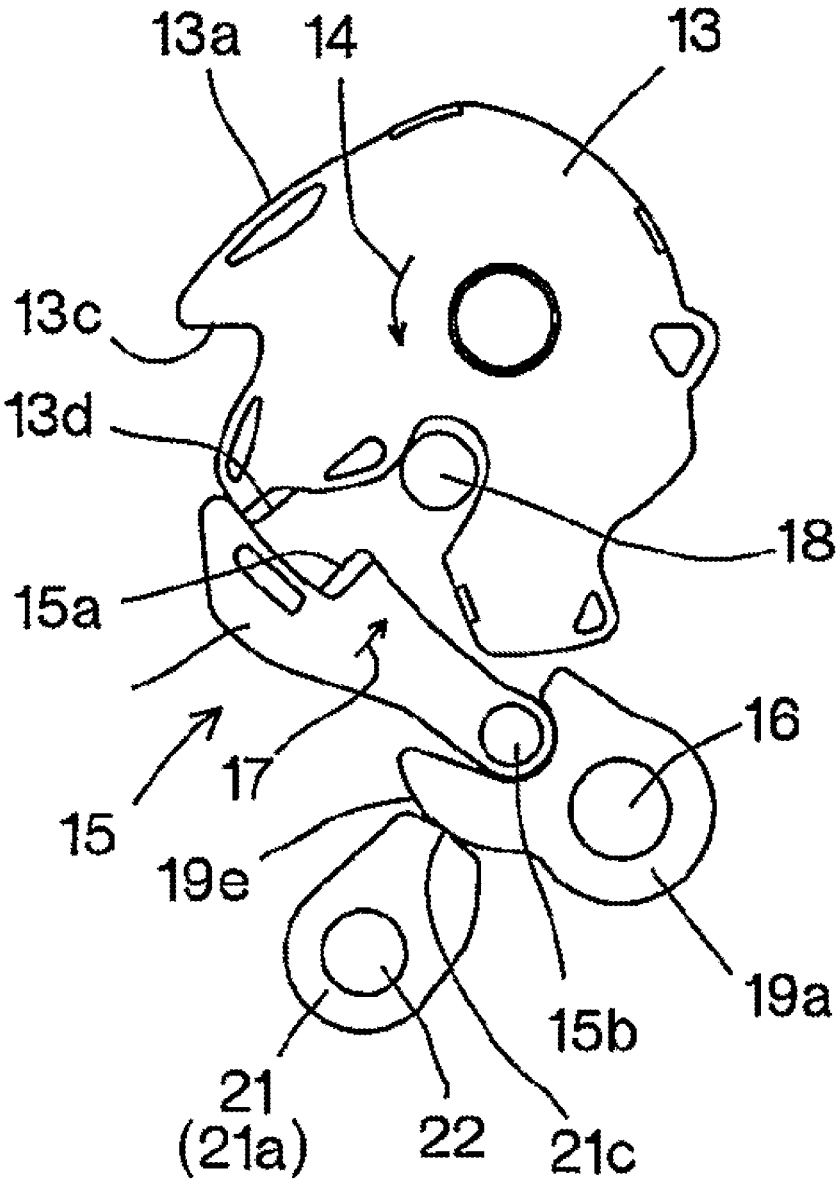
FIG. 3C is a view showing the door closing operation of the vehicle door latch apparatus of the present embodiment, wherein the latch is positioned at the over rotating position after rotation.

Latch 13 normally rotates from the unlatched position shown in FIG. 1 to the over rotating position shown in FIG. 3C through the half-latched position (FIG. 3A), where pawl portion 15*a* can be engaged with half latch engaging portion 13*c*, and through the full-latched position (FIG. 3B), where pawl portion 15*a* can be engaged with full latch engaging portion 13*d*. In FIG. 3C, pawl portion 15*a* is moved to the latch engaging position by the resilient force of ratchet spring 17.

Figure 3D:
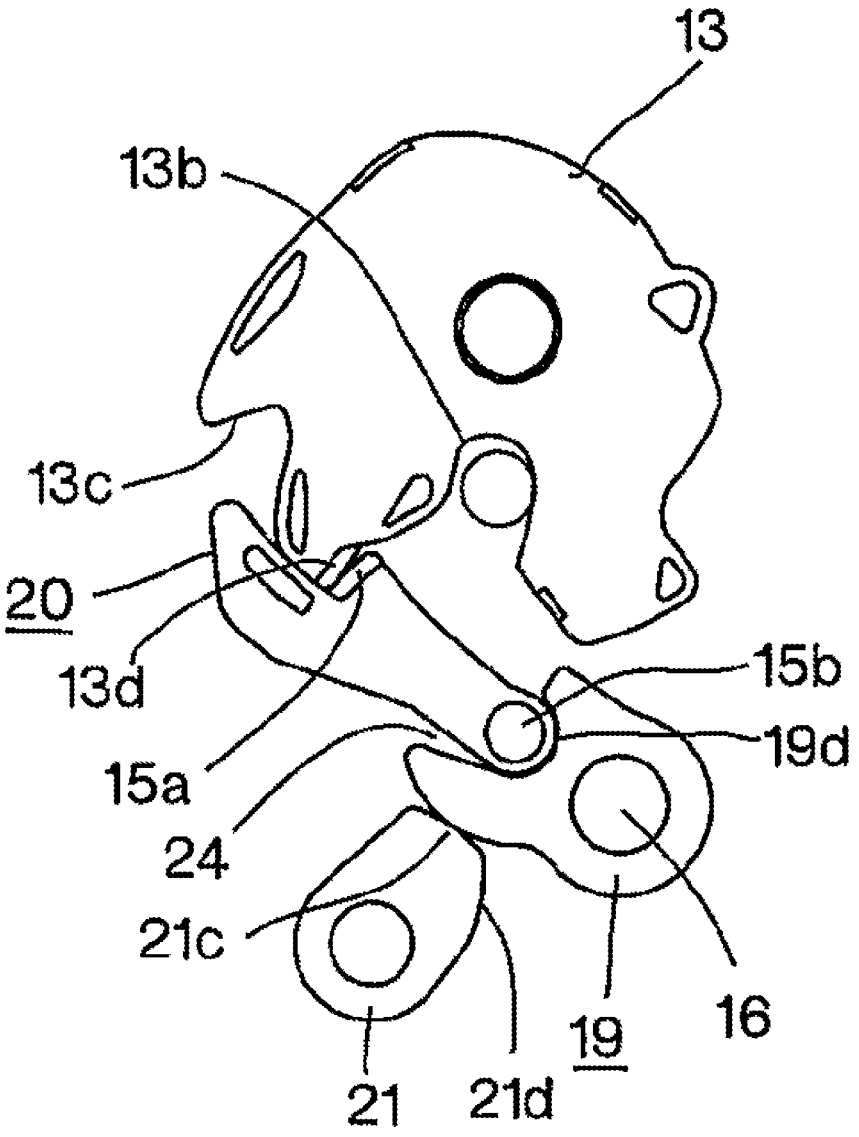
FIG. 3D is a view showing the door closing operation of the vehicle door latch apparatus of the present embodiment, wherein the latch is returned to the full-latched position and engages the ratchet member.

After rotating to the over rotating position, latch 13 is returned in the releasing direction (the counterclockwise direction) by the resilient force of latch spring 14 and by the repulsive force of a seal member (not shown) that is provided between the door and the vehicle body. Full latch engaging portion 13*d* of latch 13 then abuts against pawl portion 15*a* at the latch engaging position, as shown in FIG. 3D. The force that pushes back latch 13 in the releasing direction is referred to hereinafter as "latch return force" or "return force". As explained above, FIGS. 3A to 3D show that the state changes in the order of FIG. 3A, FIG. 3B, FIG. 3C and FIG. 3D. In the following explanation, FIGS. 3A to 3D may be collectively referred to as FIG. 3.

The return force that is transmitted from full latch engaging portion 13*d* to pawl portion 15*a* is largely received as main component force F1 by ratchet shaft 16, as will be described later, but part of the return force is set to act as release component force F2 in a direction in which ratchet member 15 is pushed out in the latch releasing direction (the direction opposite to the latch engaging direction).

As shown in FIGS. 5 to 8, ratchet member 15 of the present embodiment is divided into base lever 19 and pole lever 20. Base lever 19 and pole lever 20 are both insert molded products each including metal plate 19*a* or 20*a*, which is a structural element, and resin cover 19*b* or 20*b*. Resin cover 19*b* is omitted in FIGS. 3A to 3D and in FIGS. 4A to 4E. Note that FIGS. 4A to 4E show that the state changes in the order of FIG. 4A, FIG. 4B, FIG. 4C, FIG. 4D and FIG. 4E. In the following explanation, FIGS. 4A to 4E may be collectively referred to as FIG. 4.

The base portion of base lever 19 is rotatably supported by ratchet shaft 16, and the base portion of pole lever 20 is rotatably supported on the end portion of base lever 19 by connecting shaft 15*b*. In the present embodiment, connecting shaft 15*b* is formed integral with pole lever 20, and connecting shaft 15*b* is inserted into shaft hole 19*c* that is formed in resin cover 19*b*. Pawl portion 15*a* is formed in metal plate 20*a* of pole lever 20.

Bifurcated portion 19*d* is formed at the end portion of metal plate 19*a* of base lever 19. Connecting shaft 15*b* of pole lever 20 is arranged inside of bifurcated portion 19*d*. Gap 24 that is formed between bifurcated portion 19*d* and pole lever 20 (see FIG. 6) allows pole lever 20 to rotate relative to base lever 19 within a predetermined rotation angle.

Figure 6:
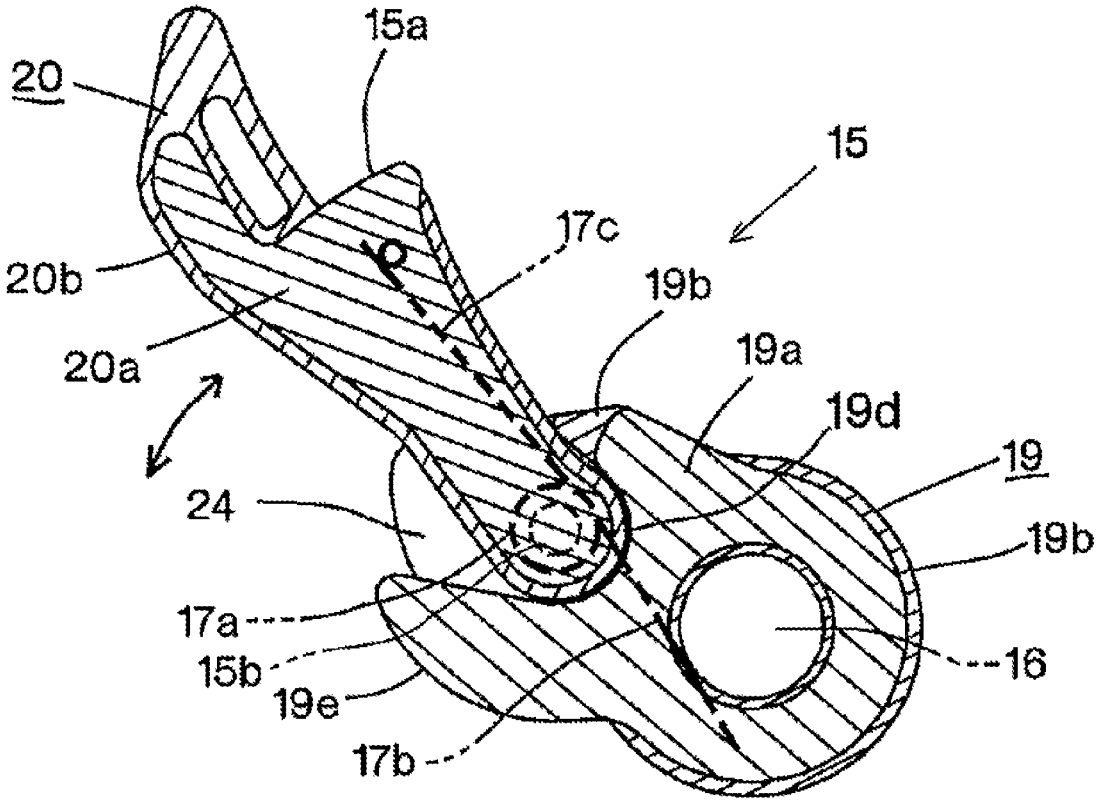
FIG. 6 is a longitudinal cross-sectional view of the ratchet member of the present embodiment, wherein the ratchet spring is shown by the imaginary line.
Figure 7:
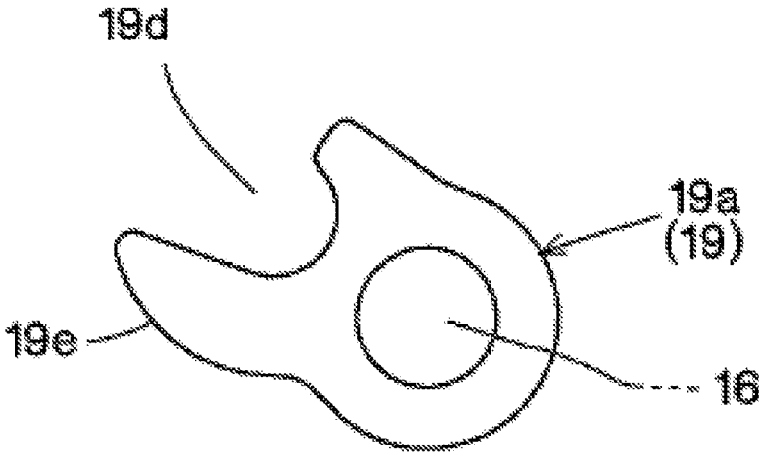
FIG. 7 is a front view of the metallic plate of the base lever of the ratchet member of the present embodiment.
Figure 8:
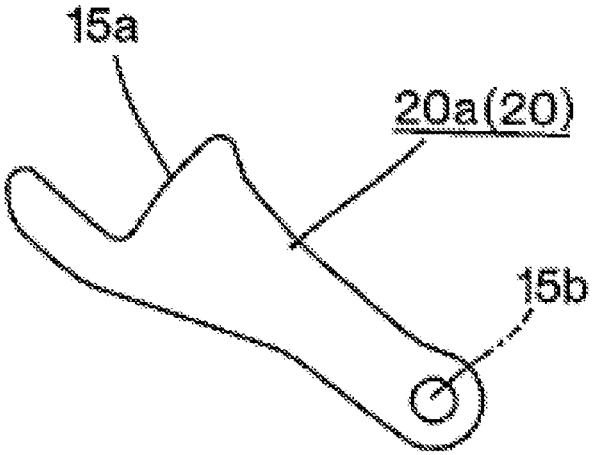
FIG. 8 is a front view of the metallic plate of the pole lever of the ratchet member of the present embodiment.
Figure 9:
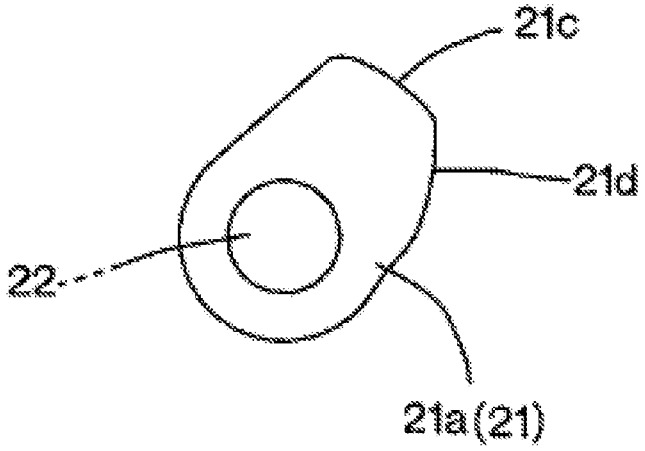
FIG. 9 is a front view of the metallic plate of the ratchet restraint of the present embodiment.
Figure 10:
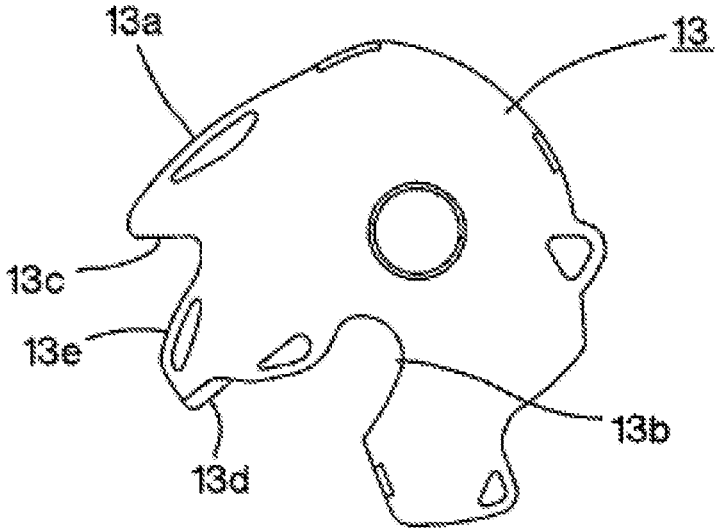
FIG. 10 is an enlarged front view of the latch of the present embodiment.

As shown in FIG. 6, ratchet spring 17 is preferably made of a torsion coil spring. Center coil portion 17*a* is disposed around the outer circumference of connecting shaft 15*b*. One spring leg portion 17*b* is in contact with ratchet shaft 16, and the other spring leg portion 17*c* is in contact with pole lever 20. According to this spring arrangement, the resilient force of ratchet spring 17 does not substantially act on base lever 19, and the resilient force acts exclusively on bias pole lever 20 about connecting shaft 15*b* in the latch engaging direction.

Ratchet member 15 has connecting shaft 15*b* that is arranged at an intermediate position in the length direction thereof and that rotatably supports base lever 19 and pole lever 20. Therefore, when release component force F2 is generated in ratchet member 15, release component force F2 that is directed in the latch releasing direction acts exclusively on connecting shaft 15*b* that is positioned at the intermediate position, to bend ratchet member 15 at the intermediate position, and disengages pawl portion 15*a* from full latch engaging portion 13*d*. Therefore, it is impossible for ratchet member 15 alone to keep latch 13 at the full-latched position.

Ratchet restraint 21 is disposed in the vicinity of the side of ratchet member 15. Ratchet restraint 21 keeps ratchet member 15 engaged with latch 13 by preventing ratchet member 15 from moving in the latch releasing direction. Ratchet restraint 21 is rotatably supported on base plate 11 by pin 22. Ratchet restraint 21 is an insert molded product that includes metal plate 21*a* and resin cover 21*b*. Resin cover 21*b* is omitted in FIGS. 3A to 3D and in FIGS. 4A to 4E.

Metallic plate 21*a* of ratchet restraint 21 is formed to be a rotating cam. On the outer circumference of metal plate 21*a*, arc-shaped blocking surface 21*c* whose center is positioned at pin 22 and inclined cam surface 21*d* that extends contiguous with blocking surface 21*c* are formed. Inclined cam surface 21*d* is a cam surface whose radius from pin 22 gradually decreases. Blocking surface 21*c* and inclined cam surface 21*d* abut against one of outer walls 19*e* of bifurcated portion 19*d* of metal plate 19*a*.

Figure 2:
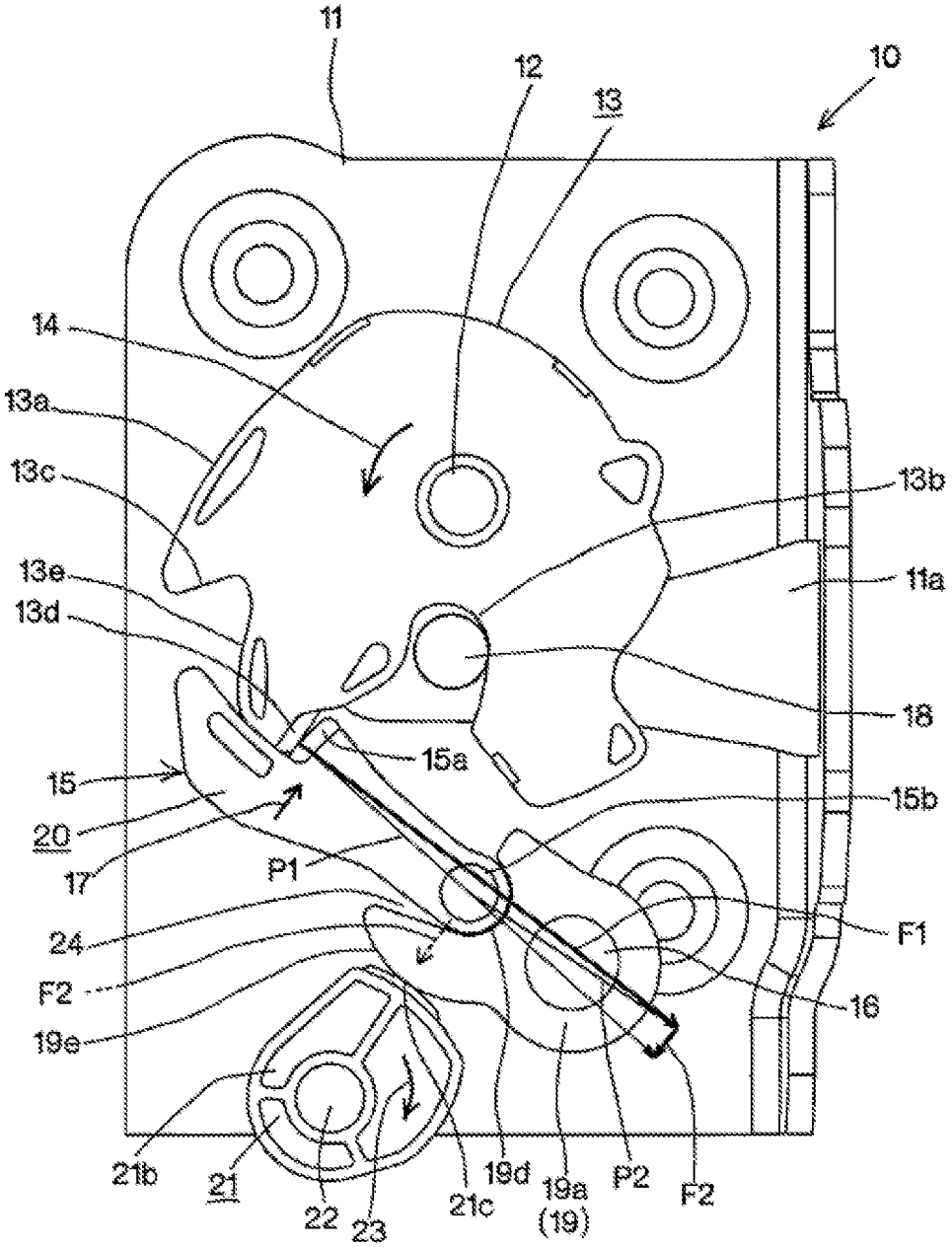
FIG. 2 is a front view of the vehicle door latch apparatus of the present embodiment showing the full-latched state (the state in which the door is closed)
Figure 4A:
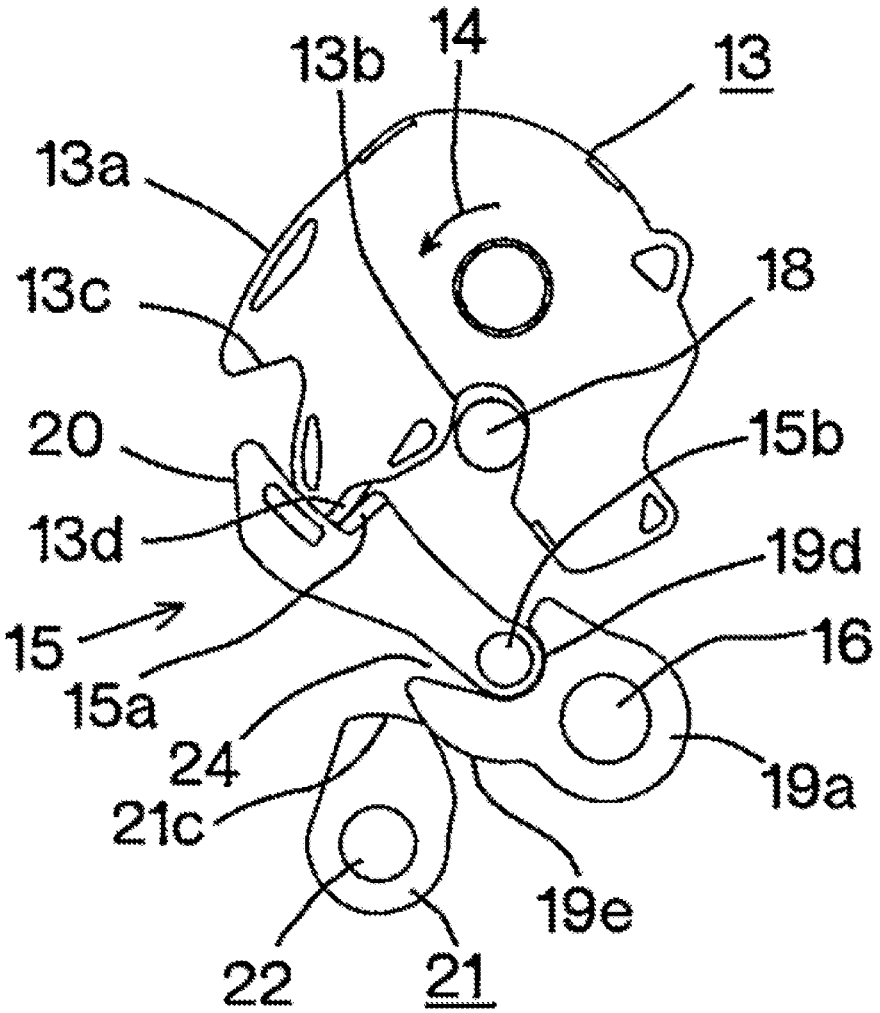
FIG. 4A is a view showing the door opening operation of the vehicle door latch apparatus of the present embodiment, wherein the ratchet restraint is at an early stage of rotation in the releasing direction.
Figure 4B:
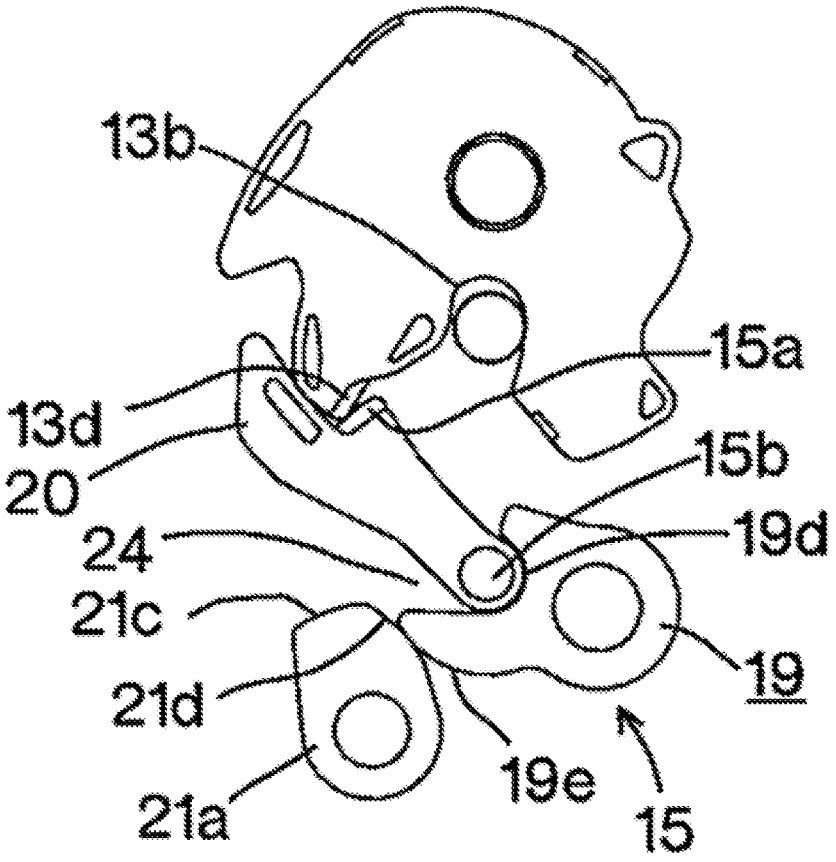
FIG. 4B is a view showing the door opening operation of the vehicle door latch apparatus of the present embodiment, wherein the ratchet member is bent at the maximum angle, and (C) shows that the ratchet member is disengaged from the latch.
Figure 4C:
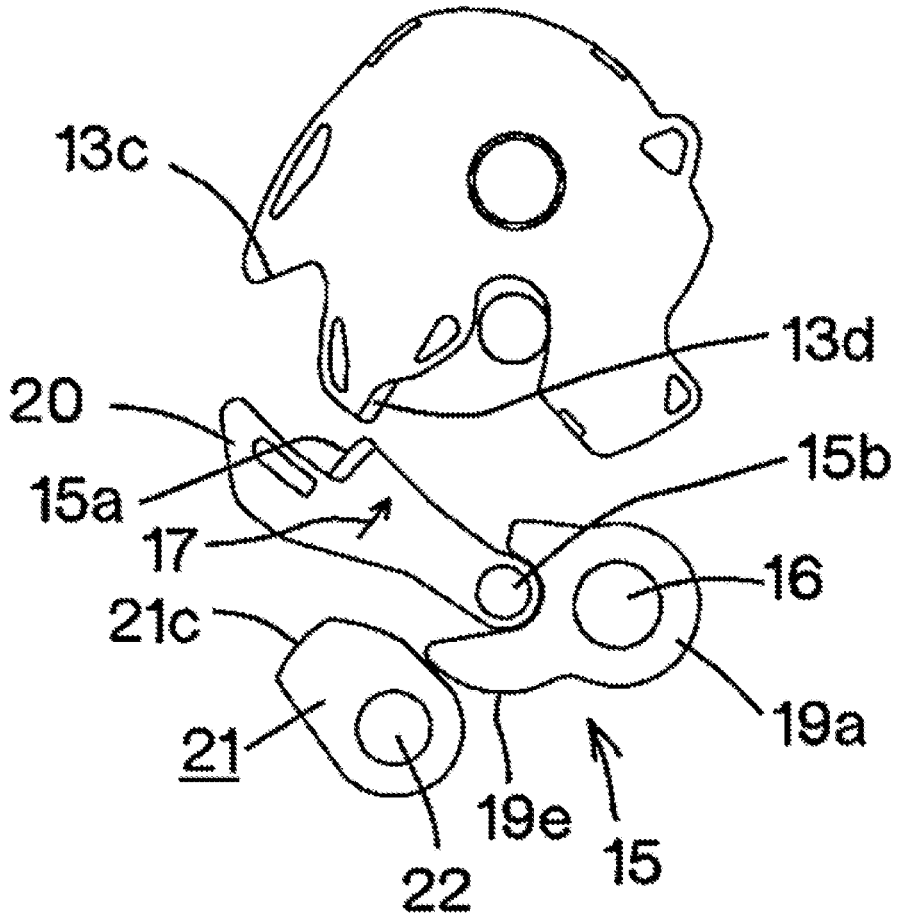
FIG. 4C is a view showing the door opening operation of the vehicle door latch apparatus of the present embodiment, wherein the ratchet member is disengaged from the latch.
Figure 4D:
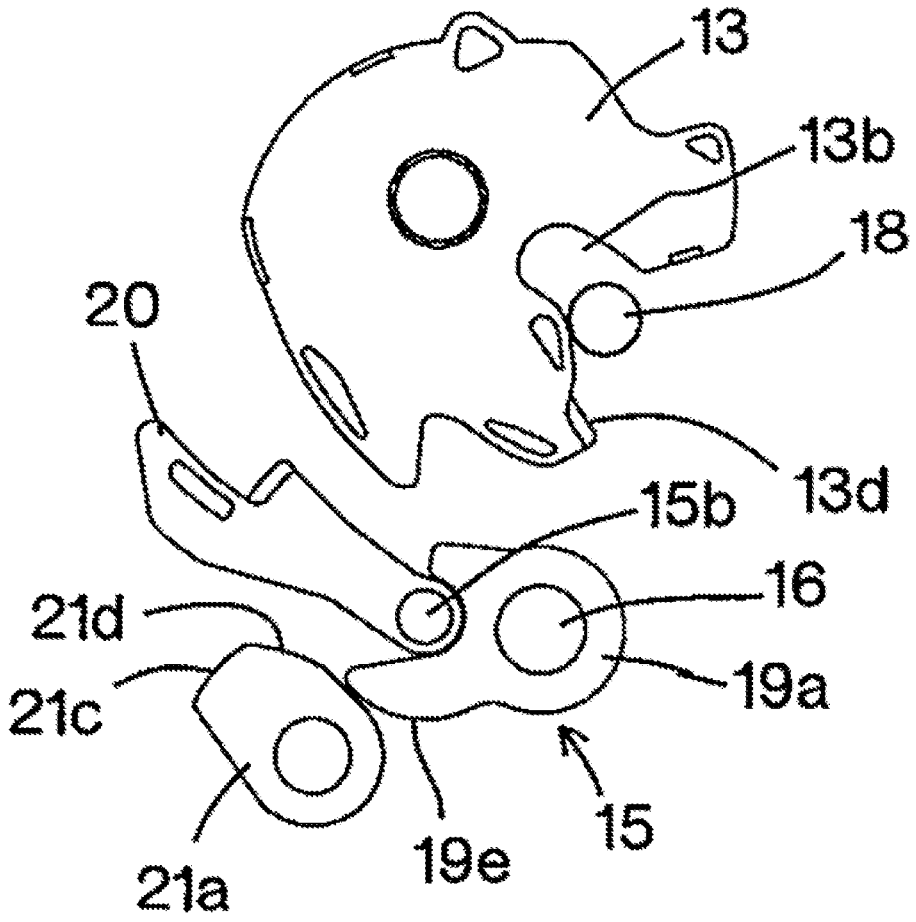
FIG. 4D is a view showing the door opening operation of the vehicle door latch apparatus of the present embodiment, wherein the ratchet restraint is rotated at the maximum angle in the releasing direction.

Ratchet restraint 21 is rotatable between the block position shown in FIGS. 1 to 3 and the release position shown in FIG. 4D. The block position corresponds to the initial position of ratchet restraint 21. Ratchet restraint 21 is preferably biased from the release position towards the block position by the resilient force of cam biasing spring 23 (shown by an arrow indicating the direction of resilience). Manual release operation force from the door opening handle, a door key cylinder or the like, or electric release operation force from a power release mechanism is transmitted to ratchet restraint 21. Ratchet restraint 21 is rotated in the releasing direction from the block position to the release position by the manual or electric release operation force.

When the release operation force is not exerted, ratchet restraint 21 is held at the block position that corresponds to the initial position by the resilient force of cam biasing spring 23. At the block position, blocking surface 21*c* of ratchet restraint 21 is located on an extension line along which connecting shaft 15*b* of ratchet member 15 is moved by release component force F2.

In the door closed state in FIG. 2, outer wall 19*e* of base lever 19 is in contact with blocking surface 21*c* at the block position. Therefore, even if the latch returning force acting on latch 13 is transmitted to pawl portion 15*a* of ratchet member 15 via full latch engaging portion 13*d*, and release component force F2 to push ratchet member 15 (in particular, connecting shaft 15*b*) in the latch releasing direction is generated in ratchet member 15, outer wall 19*e* that is on the line of action of release component force F2 that acts on connecting shaft 15*b* faces and abuts against blocking surface 21*c* at the block position. Therefore, connecting shaft 15*b* is prevented from moving in the latch releasing direction, and is held where it is positioned. As a result, ratchet member 15 is not bent at the intermediate position, maintains the engagement between pawl portion 15*a* and full latch engaging portion 13*d*, and keeps the door closed. The position where outer wall 19*e* abuts against blocking surface 21*c* at the block position is the restricted position of base lever 19.

In the door closed state in FIG. 2, when the manual release operation force or the electric release operation force is transmitted to ratchet restraint 21, ratchet restraint 21 is rotated in the releasing direction against the resilient force of cam biasing spring 23. FIG. 4 shows in detail how ratchet member 15 operates as ratchet restraint 21 is rotated in the releasing direction.

When ratchet restraint 21 is rotated in the releasing direction, blocking surface 21*c* that faces and that is in contact with outer wall 19*e* moves out of the line of action of release component force F2 that acts on connecting shaft 15*b*. Then, base lever 19 (metallic plate 19*a*) rotates in the latch releasing direction such that it can move from the restricted position to the unrestricted position and such that connecting shaft 15*b* can move in the latch releasing direction along releasing component force F2. As a result, ratchet member 15 is bent at the intermediate position. Pawl portion 15*a* is flipped out of full latch engaging portion 13*d* in the latch releasing direction, and, as shown in FIG. 4D, latch 13 rotates in the releasing direction to open the door. The non-restricted position of base lever 19 is a position where connecting shaft 15*b* is moved in the latch releasing direction and where ratchet member 15 is bent at the intermediate position.

Figure 4E:
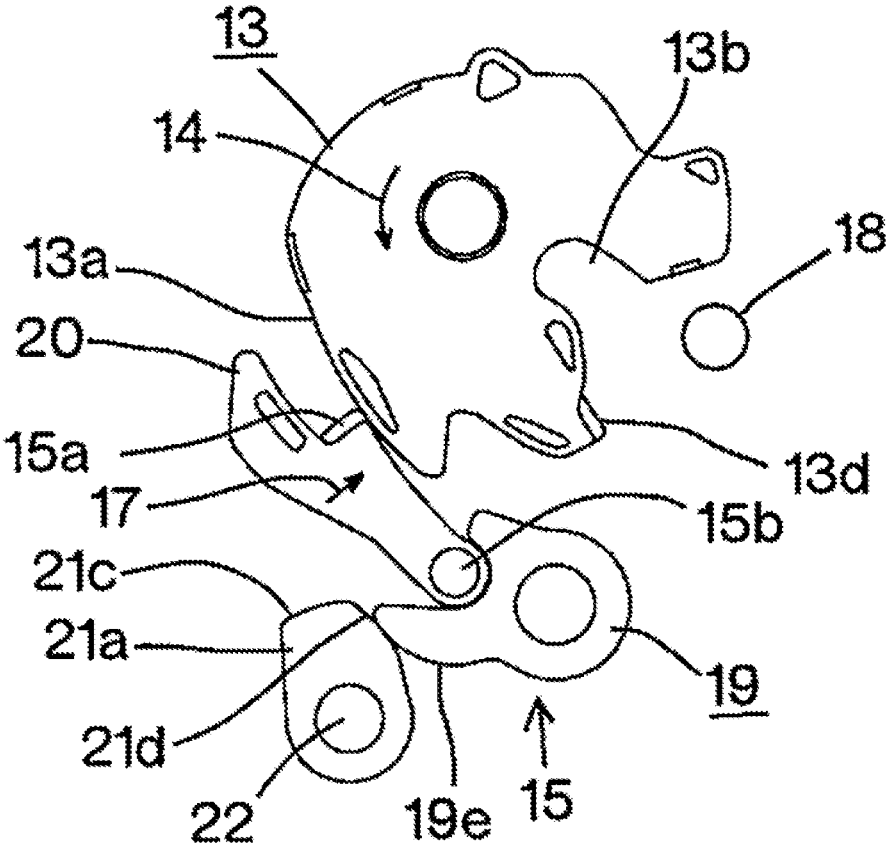
FIG. 4E is a view showing the door opening operation of the vehicle door latch apparatus of the present embodiment, wherein the ratchet restraint is returned to the block position, where the ratchet member abuts against the outer circumference of the latch.
Figure 5:
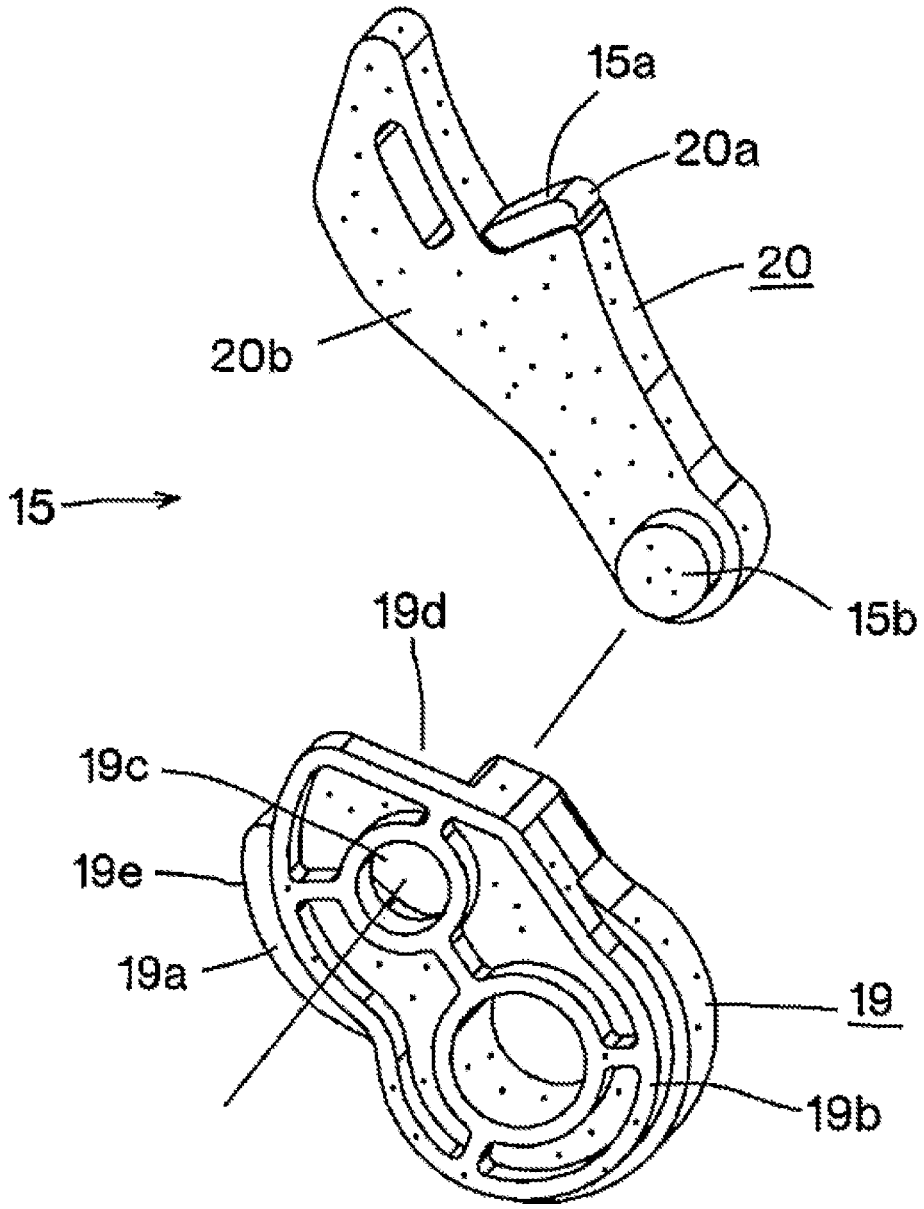
FIG. 5 is an exploded perspective view of the ratchet member of the present embodiment.

After latch 13 is rotated in the latch releasing direction, the manual release operation force or the electric release operation force acting on ratchet restraint 21 is disconnected. Then, ratchet restraint 21 is rotated in the direction opposite to the latch releasing direction back to the block position by the resilient force of cam biasing spring 23. Inclined cam surface 21*d* that is rotated in the direction opposite to the releasing direction then presses outer wall 19*e* to return base lever 19 from the non-restricted position to the restricted position by pushing base lever 19 in the latch engaging direction. As shown in FIG. 4E, pawl portion 15*a* of ratchet member 15 then abuts against outer circumference 13*a* of latch 13 in order to restore the unlatched state shown in FIG. 1.

In the door opened state shown in FIG. 1, outer wall 19*e* of base lever 19 is in contact with blocking surface 21*c* at the block position. Further, outer wall 19*e* continues to be in contact with blocking surface 21*c* until latch 13 reaches the over rotating position shown in FIG. 3D. In the meantime, pole lever 20 is independently movable in the latch engaging direction due to gap 24 that is formed between pole lever 20 and bifurcated portion 19*d*. Therefore, pole lever 20 is movable to the latch engaging position due to the resilient force of ratchet spring 17 even in the state shown in FIGS. 3A and 3B.

Figure 11:
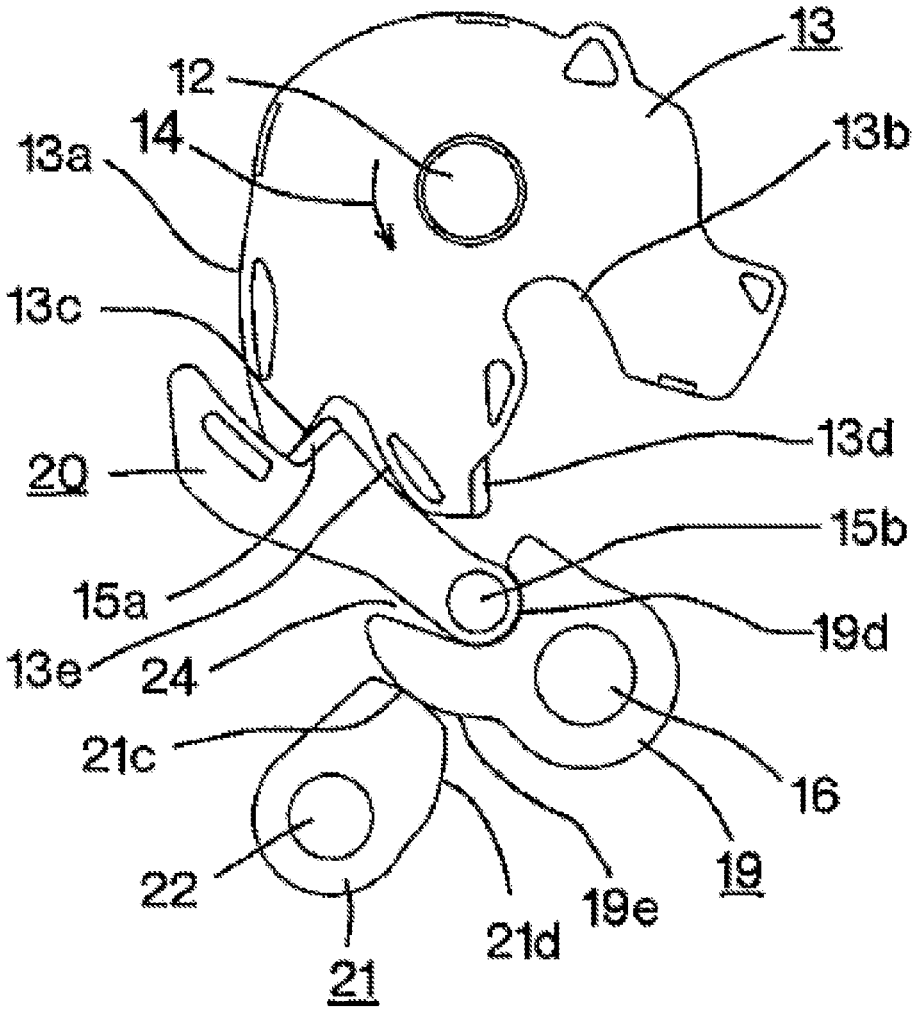
FIG. 11 is a front view showing the half latch state in which the pawl portion of the ratchet member is engaged with the half latch engaging portion of the latch of the present embodiment.

When latch 13 is at the half-latched position shown in FIG. 3A, pawl lever 20 moves to the latch engaging position due to the resilient force of ratchet spring 17, and as shown in FIG. 11, pawl portion 15*a* of pawl lever 20 may be half-latched by engaging half latch engaging portion 13*c*. Even in this half latch state, ratchet restraint 21 holds ratchet member 15 at the latch engaged position, thereby prevents latch 13 from rotating in the releasing direction and avoids unexpected opening of the vehicle door.

In the half latch state, pawl portion 15*a* can be disengaged from half latch engaging portion 13*c* by rotating latch 13 toward the full-latched position. By pushing out latch 13 toward the full-latched position, connecting slope 13*e* that is formed between half latch engaging portion 13*c* and full latch engaging portion 13*d* abuts against pole lever 20. Since gap 24 is formed between pole lever 20 and bifurcated portion 19*d*, pole lever 20 is then independently pushed out in the latch releasing direction, without rotating base lever 19, due to contact with connecting slope 13*e*. As a result, pawl portion 15*a* is disengaged from half latch engaging portion 13*c*.

Therefore, in the configuration in which ratchet restraint 21 prevents ratchet member 15 from moving in the latch releasing direction, half latch engaging portion 13*c* and half latch engaging portion 13*d* can be arranged on the outer circumference of latch 13.

When ratchet restraint 21 is mainly rotated by the power release mechanism, cam biasing spring 23 may be omitted. In this case, after rotating ratchet restraint 21 from the block position to the release position, the power release mechanism returns ratchet restraint 21 from the release position to the block position. In this control operation, it is possible to use rotational position control, such as a limit switch or a contact stopper, or time-controlled rotational position control. When the power release mechanism is used, it is also possible to rotate ratchet restraint 21 360 degrees from the block position and to stop ratchet restraint 21 again at the block position. This configuration is advantageous in terms of both the structural and control aspects because the rotation is limited to one direction. In the case of rotating ratchet restraint 21 360 degrees, in addition to inclined cam surface 21*d* that is detached from base lever 19 to allow base lever 19 to move to the non-restricted position, ratchet restraint 21 has an additional inclined cam surface that pushes base lever 19 back to the restricted position.

Figure 12:
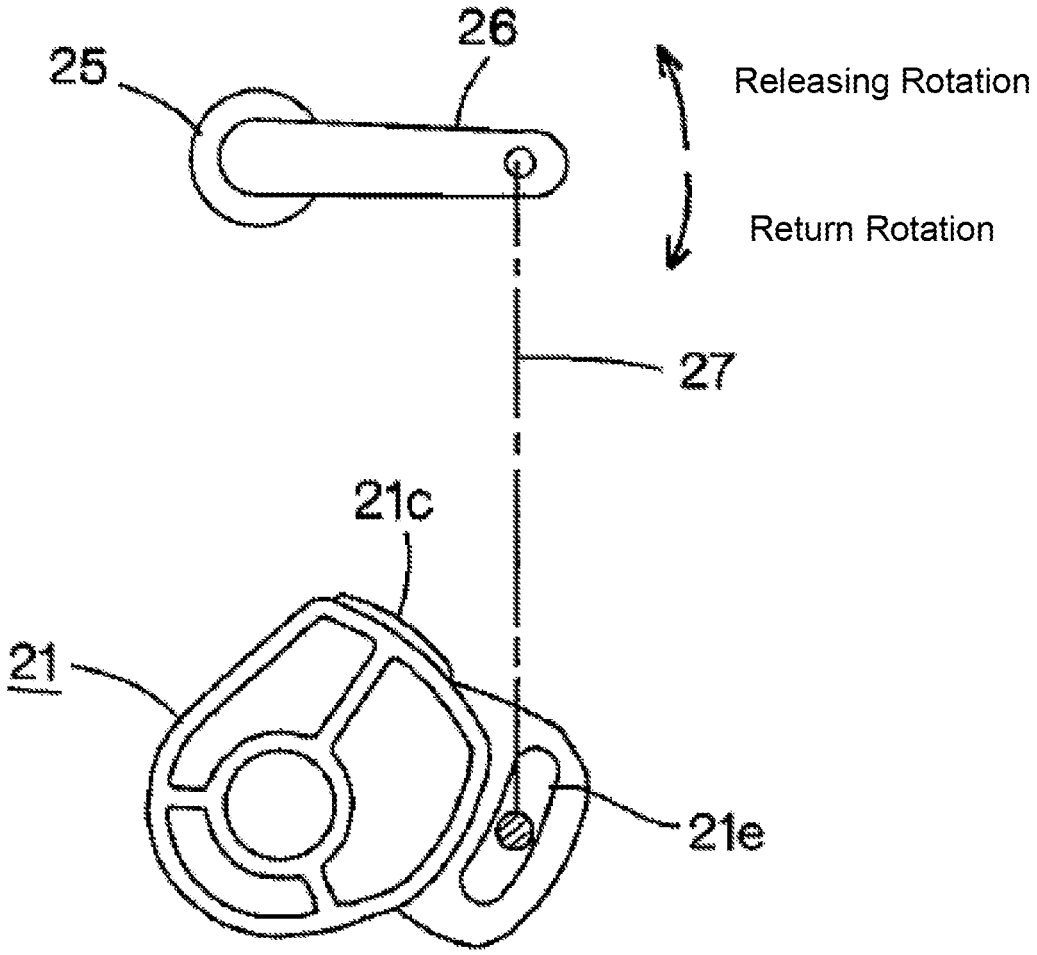
FIG. 12 is a schematic diagram showing coupling means to couple the ratchet restraint to the door key cylinder in the present embodiment.
Figure 13:
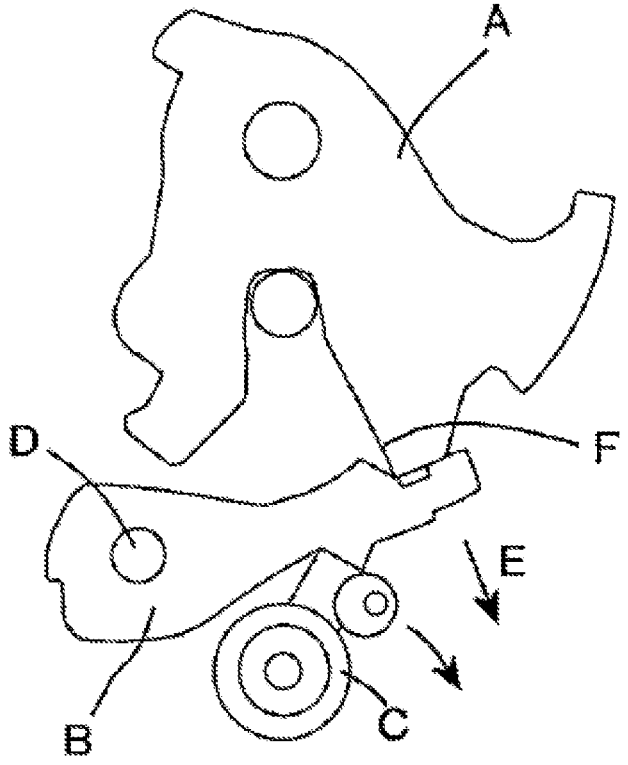
FIG. 13 is a view of a known example showing a conventional mechanism for reducing release operation force.

An embodiment in which ratchet restraint 21 is connected to door key cylinder 25 is shown in FIG. 12. As shown in FIG. 12, arc-shaped slot 21*e* is formed in plastic cover 21*b* of ratchet restraint 21, and slot 21*e* is connected to pivoting link 26 of door key cylinders 25 via rod 27. Rod 27 is positioned at an intermediate part of slot 21*e* in the longitudinal direction thereof to provide a predetermined space on both sides. This enables ratchet restraint 21 to rotate between the block position and the release position without being affected by door key cylinder 25. Further, by using door key cylinder 25 to rotate pivoting link 26 from the neutral position in the releasing direction or in the returning direction and then to rotate pivoting link 26 back to the neutral position, it is possible to move ratchet restraint 21 to the release position or to the block position, respectively.

Since electrical components, such as a power release mechanism that is coupled to ratchet restraint 21, cannot be completely free of electrical problems, it is desirable that ratchet restraint 21 be coupled both to the power release mechanism and to door key cylinder 25. By doing so, even if the power release mechanism becomes inoperable during operation, it is possible to rotate door key cylinder 25 in the releasing direction to move ratchet restraint 21 to the release position, thereby to move ratchet member 15 to the latch releasing position, and thereby to release latch 13 to make the vehicle door openable. In addition, since ratchet restraint 21 can be returned to the block position, which is the initial position, by rotating back door key cylinder 25 after the vehicle door is opened, the vehicle door can be stably closed next time.

In the above description, the friction force between ratchet member 15 and ratchet restraint 21, which is generated when ratchet restraint 21 is rotated from the block position in FIG. 2 to the release position, can be effectively reduced, as compared to a conventional apparatus, and further reduction in the release operation force for rotating ratchet 21 can be expected.

The latch returning force for latch 13 is transmitted as external force P1 from the contact point between full latch engaging portion 13*d* and pawl portion 15*a* to connecting shaft 15*b*, and is then transmitted as external force P2 from connecting shaft 15*b* to ratchet shaft 16. These external forces P1 and P2 are separated into main component force F1 and release component force F2.

Pawl portion 15*a* may engage full latch engaging portion 13*d* either at a deep position or at a shallow position. Therefore, in a strict sense, the contact point of pawl portion 15*a* is different each time. Such variation of the contact point leads to the variation of the direction and the strength of external force P1 that is transmitted to connecting shaft 15*b*. The same applies to the direction of external force P2. As a result, main component force F1 and release component force F2 are variable.

In order to avoid such variation, pawl portion 15*a* of the present embodiment is formed as an arc surface whose center is positioned at connecting shaft 15*b*. By forming pawl portion 15*a* as an arc surface, even if the position where pawl portion 15*a* engages full latch engaging portion 13*d* is shifted, external force P1 always acts on the axial center of connecting shaft 15*b*. As a result, the direction and the strength of external force P1 is stabilized, and a change in external force P2, main component force F1 and release component force F2 can be prevented. Since release component force F2 becomes constant, the contact pressure between ratchet restraint 21 and ratchet member 15 becomes constant, and the release operation force of ratchet restraint 21 stably acts on ratchet member 15.

The latch returning force is transmitted to ratchet member 15 both from full latch engaging portion 13*d* and from half latch engaging portion 13*c*. Although some part of the above explanation only refers to the relationship between full latch engaging portion 13*d* and pawl portion 15*a*, the same applies to the relationship between half latch engaging portion 13*c* and pawl portion 15*a*.

LIST OF REFERENCE NUMERALS

10 Vehicle door latch apparatus
11 Base plate
11*a* Striker entrance
12 Latch shaft
13 Latch
13*a* Outer circumference
13*b* Striker engaging groove
13*c* Half latch engaging portion
13*d* Full latch engaging portion
13*e* Connecting slope
14 Latch spring
15 Ratchet member
15*a* Pawl portion
15*b* Connecting shaft
16 Ratchet shaft
17 Ratchet spring
17*a* Coil portion
17*b* Spring leg portion
17*c* Spring leg portion
18 Striker
19 Base lever
19*a* Metal plate
19*b* Resin cover
19*c* Shaft hole
19*d* Bifurcated portion
19*e* Outer wall
20 Pole lever
20*a* Metal plate
20*b* Resin cover
21 Ratchet restraint

21*a* Metal plate
21*b* Resin cover
21*c* Blocking surface
21*d* Inclined cam surface
21*e* Slot
22 Pin
23 Cam biasing spring
24 Gap
25 Door key cylinder
26 Pivoting link
27 Rod
F1 Main component force
F2 Release component force
P1 External force
P2 External force

What is claimed is:

1. A vehicle door latch apparatus comprising:

a latch that is engaged with a striker and that is rotatable from an unlatched position to an over rotating position;

a ratchet member that is rotatably supported by a ratchet shaft and that has a pawl portion, wherein the pawl portion is movable between a latch engaging position and a latch releasing position, the latch engaging position being where the pawl portion can face a half latch engaging portion of the latch, the latch releasing position being where the pawl portion is not in contact with the half latch engaging portion, wherein a release component force is generated in a latch releasing direction when a latch return force is applied in a releasing direction at the latch engaging position, and the ratchet member is pushed out from the latch engaging position to the latch releasing position by the release component force; and a ratchet restraint that is arranged on a side of the ratchet member and that can be moved about a pin between a block position and a release position, wherein at the block position, the ratchet restraint abuts against the ratchet member to prevent the ratchet member from moving from a latch engaging position to a latch disengaging position, the latch engaging position being where the ratchet member engages the latch and wherein at the release position, the ratchet restraint is detached from the ratchet member to allow the ratchet member to move from the latch engaging position to the latch disengaging position, wherein the ratchet member has a pawl lever, wherein the ratchet member has a base lever that is rotatably supported by the ratchet shaft, and the pawl lever is rotatably supported on the base lever by a connecting shaft, wherein the pawl lever is pressed against the base lever in a latch engaging direction by a resilient force of a ratchet spring, a coil portion of the ratchet spring is supported by the connecting shaft, one of spring legs of the ratchet spring is in contact with and engaged with the ratchet shaft, and the other is engaged with the pawl lever.

2. The vehicle door latch apparatus according to claim 1, wherein the ratchet restraint has a blocking surface, which is an arc surface whose center is positioned at the pin, and an inclined surface that extends contiguous with the blocking surface and whose radius from the pin gradually decreases, wherein the pawl lever is in contact with a full latch engaging portion on the latch when the ratchet restraint is at the block position and the base lever is at a restricted position where the base lever is in contact with the blocking surface of the ratchet restraint, and wherein the pawl lever can be disengaged from the full latch engaging portion on the latch by rotating about the connecting shaft in a latch disengaging direction while the base lever is rotated to slide from the blocking surface to the inclined surface of the ratchet restraint to a non-restricted position by the release component force.

3. The vehicle door latch apparatus according to claim 1, wherein the latch has the full latch engaging portion that is arranged together with the half latch engaging portion.

4. The vehicle door latch apparatus according to claim 1, wherein the ratchet restraint includes a cam biasing spring that biases the ratchet restraint from the release position toward the block position.

5. The vehicle door latch apparatus according to claim 2, wherein the ratchet restraint includes a cam biasing spring that biases the ratchet restraint from the release position toward the block position, and wherein the inclined surface of the ratchet restraint returns the base lever from the unrestricted position to the restricted position when the ratchet restraint is returned to the block position from the release position by resilient force of the cam biasing spring.

6. The vehicle door latch apparatus according to claim 1, wherein the ratchet restraint can be shifted between the block position and the release position by a manual release operation force.

7. The vehicle door latch apparatus according to claim 1, wherein the base lever includes a bifurcated portion, and the connecting shaft is arranged inside of the bifurcated portion such that a gap is formed between the bifurcated portion and the pole lever, the gap allowing the pawl lever to rotate relative to the base lever within a predetermined rotation angle.

* * * * *